US007567027B2

(12) United States Patent
Lee

(10) Patent No.: US 7,567,027 B2
(45) Date of Patent: Jul. 28, 2009

(54) NEGATIVE HOLE STRUCTURE HAVING A PROTRUDED PORTION AND ELECTRON EMISSION DEVICE INCLUDING THE SAME

(75) Inventor: Sang Jin Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 621 days.

(21) Appl. No.: 11/097,098

(22) Filed: Mar. 31, 2005

(65) Prior Publication Data

US 2005/0236962 A1 Oct. 27, 2005

(30) Foreign Application Priority Data

Mar. 31, 2004 (KR) ..... 10-2004-0021945

(51) Int. Cl.
*H01J 63/04* (2006.01)
*C25F 3/00* (2006.01)

(52) U.S. Cl. ..... 313/495; 216/11; 216/72

(58) Field of Classification Search ..... None
See application file for complete search history.

(56) References Cited

U.S. PATENT DOCUMENTS 5,817,201 A * 10/1998 Greschner et al. ..... 156/150
6,022,256 A * 2/2000 Rolfson ..... 445/24
6,139,385 A * 10/2000 Raina ..... 445/24
6,204,597 B1 3/2001 Xie et al.
6,942,815 B2 * 9/2005 Umehara ..... 216/27
7,105,097 B2 * 9/2006 Hess ..... 216/27
2001/0054871 A1 12/2001 Tadaki et al.
2005/0057168 A1 * 3/2005 Song et al. ..... 315/111.81
2005/0139817 A1 * 6/2005 Choi et al. ..... 257/10
2006/0051708 A1 * 3/2006 Lim et al. ..... 430/321

FOREIGN PATENT DOCUMENTS

KR 1998-022876 7/1998
KR 1020010058196 * 5/2001
KR 2003-0080767 10/2003

OTHER PUBLICATIONS

SIPO Office action dated Jan. 16, 2009, for corresponding Chinese application 2005100741508, with English translation indicating relevance of listed reference in this IDS.

* cited by examiner

*Primary Examiner*—Toan Ton
*Assistant Examiner*—Britt Hanley
(74) *Attorney, Agent, or Firm*—Christie Parker & Hale LLP

(57) ABSTRACT

A negative hole is formed by etching a dielectric layer that includes at least a lower dielectric sublayer and an upper dielectric sublayer. The lower dielectric sublayer and the upper dielectric sublayer have substantially the same permittivity, and the lower dielectric sublayer may have a higher etching rate lower than the upper dielectric sublayer. The negative hole formed in the upper and lower dielectric sublayers has an etched profile with a protruded portion protruding from at least the boundary between the lower dielectric sublayer and the upper dielectric sublayer. With various embodiments of the disclosed invention, resistance between the cathode and the gate may be secured to prevent arc generation and signal distortion.

12 Claims, 4 Drawing Sheets

NEGATIVE HOLE STRUCTURE HAVING A PROTRUDED PORTION AND ELECTRON EMISSION DEVICE INCLUDING THE SAME

CROSS-REFERENCE TO RELATED APPLICATIONS

This application claims priority to and the benefit of Korean Patent Application No. 10-2004-0021945, filed Mar. 31, 2004, in the Korean Intellectual Property Office, the entire contents of which is incorporated herein by reference.

BACKGROUND

1. Field of the Invention

The present invention relates to a negative hole structure, a method for forming the same, and an electron emission device for a flat panel display including the same. The invention relates more particularly to a negative hole structure having a protruded portion to secure resistance between electrodes and to prevent an arc between the electrodes, a method for forming the same, and an electron emission device for a flat panel display including the same.

2. Discussion of Related Art

Generally, a negative hole is formed by etching a dielectric layer that is interposed between conductive electrodes in order to prevent the conductive electrodes from short circuiting when high voltage is applied therebetween and to secure a predetermined resistance. The negative hole is formed in the dielectric layer as a simple medium of constant permittivity and has a straight, vertical profile or an inclined profile. Such a negative hole is generally used in a device having a microstructure electrode, particularly in a flat panel display, which usually has a slim shape.

A flat panel display can include a liquid crystal display (LCD), a plasma display panel (PDP), a vacuum fluorescent display (VFD), or an electron emission display, or the like. In the case of an electron emission display, an electron emission device is employed as an electron source and classified into a hot cathode type or a cold cathode type. The cold cathode type electron emission device can include a field emitter array (FEA), a surface conduction emitter (SCE), a metal insulator metal (MIM), a metal insulator semiconductor (MIS), or a ballistic electron surface emitter (BSE), or the like. Such an electron emission device can also be employed in the electron emission display, various backlights, an electron beam apparatus for lithography, etc. In an electron emission display, electrons are emitted from the electron emission region of an electron emission device, and the emitted electrons collide with a fluorescent layer to emit light in a display region.

A conventional electron emission device for a flat panel display is shown in FIG. 1. A cathode 12 is formed on a plate 11, and a dielectric layer 13 and a gate 16 are formed on the cathode 12. An electron emission source 18 is formed within the negative hole 13*a*, which is formed through the dielectric layer 13 and the gate 16. The negative hole 13*a* can have a straight, vertical profile or a straight, inclined profile.

The electron emission device with the negative hole 13*a* shown in FIG. 1 is created in the following manner. The cathode 12, the dielectric layer 13 and the gate 16 are in turn formed on the plate 11, and then the negative hole 13*a* is formed by a wet etching process or the like. Then, a carbon nano tube (CNT) is injected, developed, annealed and activated, thereby forming the electron emission source 18 within the negative hole 13*a*. However, a CNT paste contracts by 60% or more while being annealed. Where an inner wall is inclined, the CNT may not be effectively removed and is likely to remain on the inner wall of the negative hole 13*a* while being activated. The remaining CNT decreases the resistance between the cathode 12 and the gate 16, thereby causing an arc between the cathode 12 and the gate 16 and distorting an input signal.

To solve the foregoing problems, various methods have been proposed, in which the negative hole has an improved structure for preventing the short circuit between the electrodes.

One example is Korean Patent Publication No. 1998-022876, issued to Orion Electronics, Inc., which discloses a field emission display (FED) having a cathode structure with a "V"-shaped gate to apply a strong electric field. An electron emission source (emitter) is a metal tip instead of the CNT. Also, the electron emission source is a gate and not a dielectric layer, and has a downward curved structure.

Another example is Korean Patent Publication No. 2003-0080767, issued to Samsung SDI, Inc., which discloses a method of forming a negative hole having a vertical profile in order to enlarge the superficial area of a cathode and to fabricate an electron emission device for high resolution and high brightness. In this case, two or more multiple-layered dielectric layers are formed and etched at different rates. The conventional dielectric layers are etched only to make an inner wall of the negative hole have a vertical profile without a protruded structure. Prevention of arc generation and signal distortion by securing resistance between the cathode and the gate is not a stated objective or advantage of this method.

Yet another example of negative hole structure is U.S. Pat. No. 6,204,597, issued to Motorola, Inc., which discloses a negative hole that focuses an electron beam emitted from an emitter. The negative hole is formed in a dielectric layer having two dielectric materials having different pernittivities (e.g., refer to FIG. 1).

SUMMARY OF THE INVENTION

In one exemplary embodiment of the present invention, a negative hole structure is provided having a protruded portion to secure resistance between electrodes and to prevent an arc between the electrodes.

In another exemplary embodiment of the present invention, an electron emission device is provided having a negative hole, in which the resistance between a cathode and a gate is secured to prevent arc generation and signal distortion.

In still another exemplary embodiment of the present invention, a method is provided for forming a negative hole structure having a protruded portion.

In one exemplary embodiment, the dielectric layer has at least a lower dielectric sublayer and an upper dielectric sublayer having substantially the same permittivity. The lower dielectric sublayer has a first etching rate, and the upper dielectric sublayer has a second etching rate lower than the first etching rate. A negative hole is formed in the upper and lower dielectric sublayers. The negative hole has an etched profile with a portion protruding from at least the boundary between the lower dielectric sublayer and the upper dielectric sublayer.

In an embodiment of the invention, the upper dielectric sublayer and the lower dielectric sublayer are formed by adding titanium dioxide ($TiO_2$) in different quantities to silicon oxide.

According to another embodiment of the invention, the peak of the protrusion is positioned higher than half the thickness of the dielectric layer.

In another embodiment of the present invention, the upper dielectric sublayer and the lower dielectric sublayer are etched in sequence.

In one embodiment, the peak position of the protruded portion is adjusted by adjusting the thickness between the upper dielectric sublayer and the lower dielectric sublayer.

The lower dielectric sublayer may be thicker than the upper dielectric sublayer, causing the peak position of the protruded portion to be higher than half the thickness of the entire dielectric layer.

In one embodiment, the etching rates of the upper dielectric sublayer and the lower dielectric sublayer are adjusted by adding the same additives in different quantities to the same materials of the upper and lower dielectric sublayers. For example, the upper dielectric sublayer and the lower dielectric sublayer may be formed by adding titanium dioxide ($TiO_2$) in different respective quantities to silicon oxide.

In one embodiment, the entire dielectric layer is etched by an etching solution using a water:fluoric acid:nitric acid compound having a weight percentage in the range of 10~40:1:1.

In still another embodiment, an electron emission device is provided that includes: a first electrode formed on a plate; a dielectric layer formed on the first electrode and having a negative hole through which at least one portion of the first electrode is exposed; an electron emission source formed on a predetermined region of the first electrode and having at least one portion exposed through the negative hole; and a second electrode formed on the dielectric layer. The dielectric layer includes at least a lower dielectric sublayer and an upper dielectric sublayer formed as described above.

In one embodiment, the first electrode comprises ITO, and the electron emission source comprises a CNT emitter.

DETAILED DESCRIPTION

Figure 1:
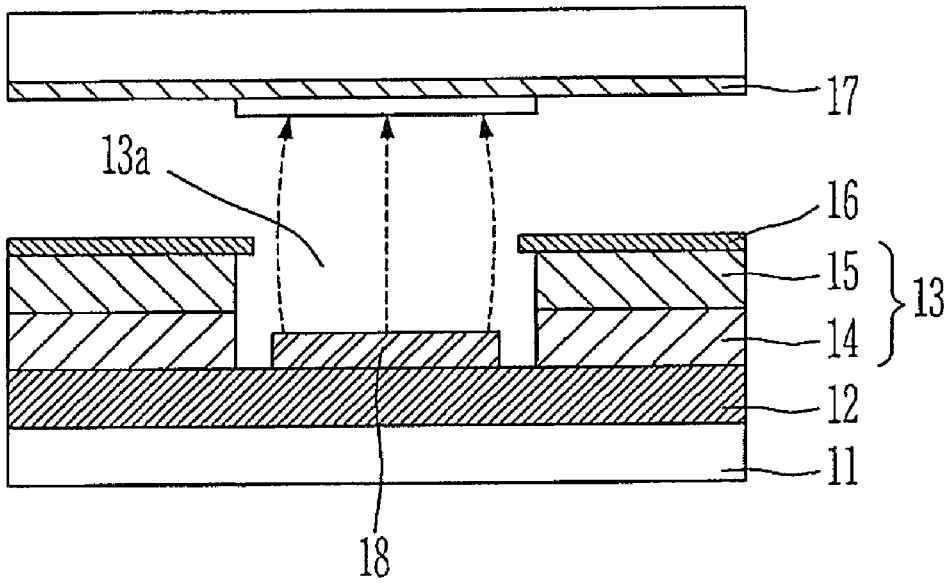
FIG. 1 (PRIOR ART)
FIG. 1 is a sectional view schematically illustrating a conventional electron emission device comprising a negative hole structure.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. In the drawings, illustrations of elements having no relation with the present invention are omitted in order to clearly present the subject matter of the present invention. Like elements are denoted by like reference numerals.

Figure 2:
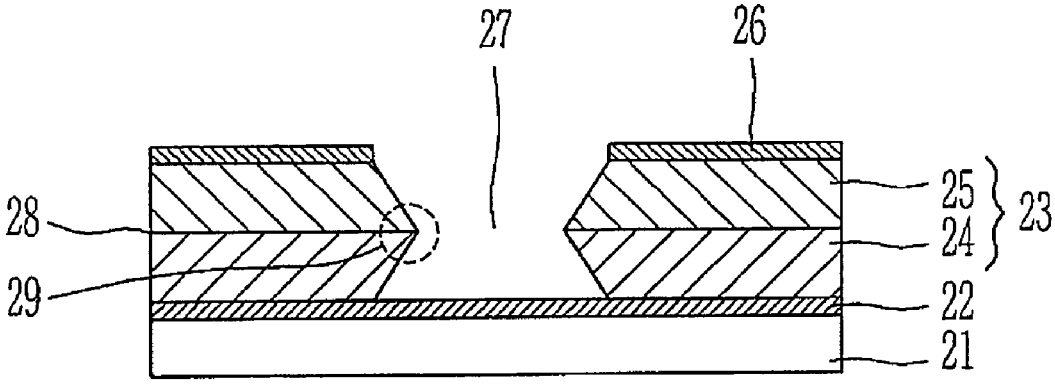
FIG. 2 is a sectional view schematically illustrating an electron emission device comprising a negative hole structure with a protrusion portion according to a first embodiment of the present invention.
Figure 3A:
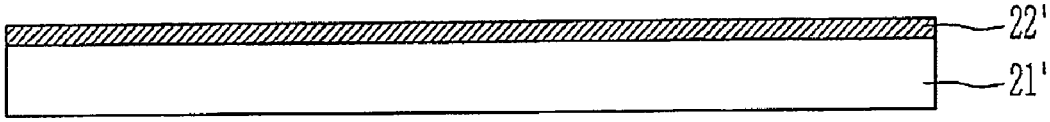
FIGS. 3A through 3I are sectional views schematically illustrating an electron emission device at various stages in the process of fabrication according to an embodiment of the present invention.
Figure 3B:
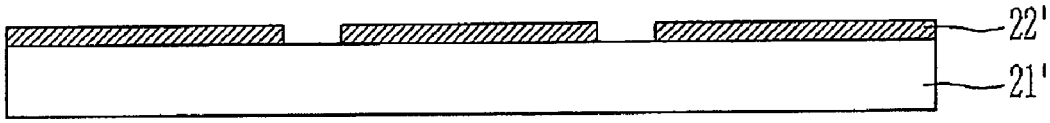
Figure 3C:
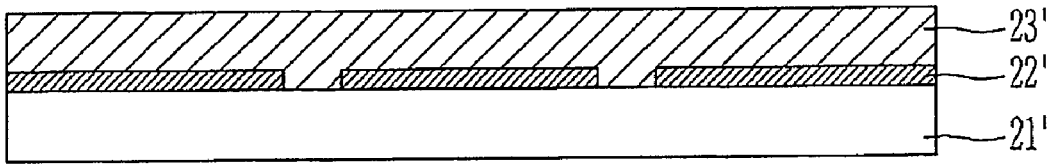
Figure 3D:
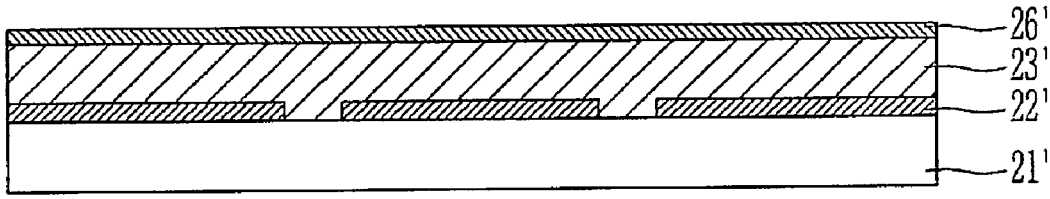
Figure 3E:
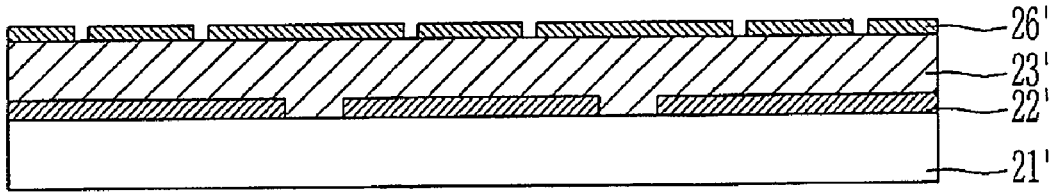
Figure 3F:
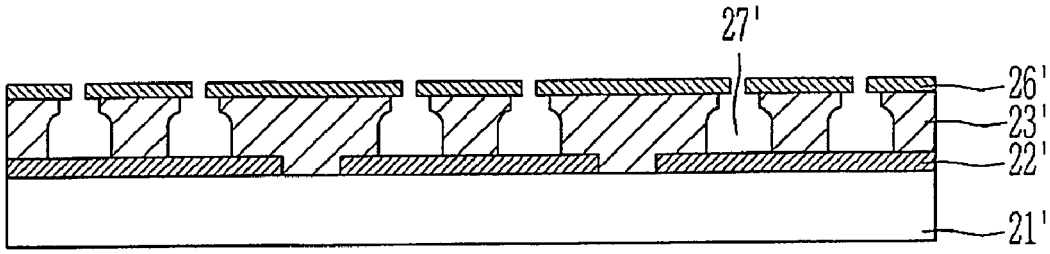
Figure 3G:
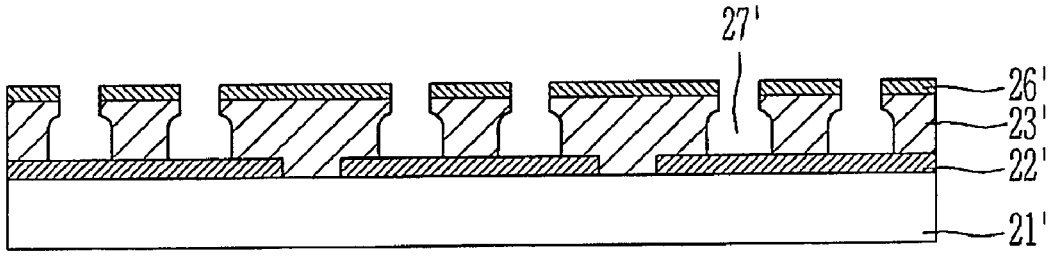
Figure 3H:
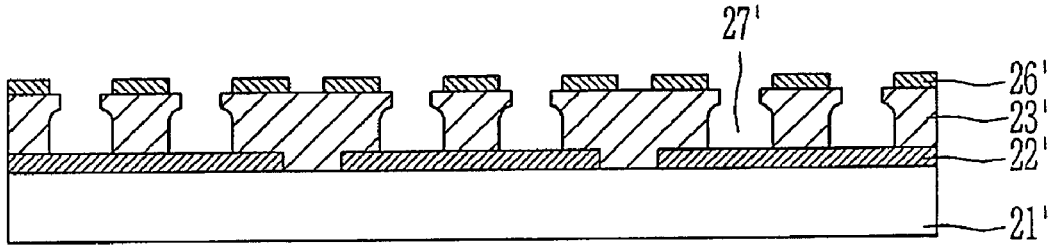
Figure 3I:
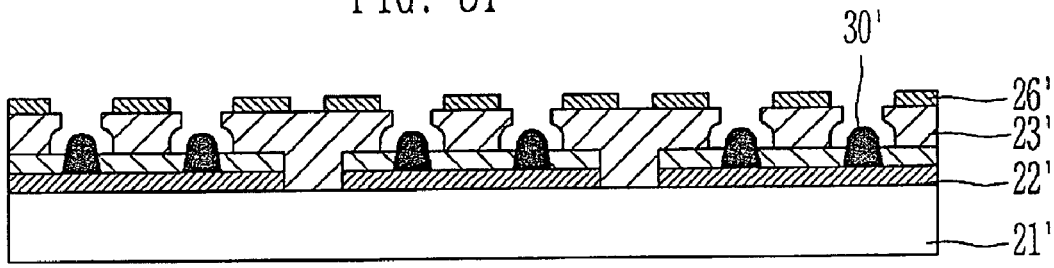

FIG. 2 shows a negative hole structure having a protruded portion 29. A cathode 22 is formed on a plate 21, and a dielectric layer 23 and a gate 26 are formed on the cathode 22. The dielectric layer 23 includes an upper dielectric sublayer 25 and a lower dielectric sublayer 24, and the protruded portion 29 is formed in the boundary between the upper dielectric sublayer 25 and the lower dielectric sublayer 24 along an inner wall of a negative hole 27. The position of the protruded portion 29 can be adjusted by changing the thickness of the upper dielectric sublayer 25 and the lower dielectric sublayer 24. For example, if the dielectric layer 23 has a thickness of 15 μm, and the upper dielectric sublayer 25 and the lower dielectric sublayer 24 have the same thickness of 7.5 μm, the protruded portion 29 is positioned in the middle of the dielectric layer 23. In one embodiment, the peak of the protruded portion 29 is positioned higher than half the thickness of the dielectric layer 23.

A protruding degree or ridge of the protruding portion 29 may be varied by adjusting the etching rate of the dielectric layer 23 through known etching techniques. To form the negative hole structure having a protruded portion according to one embodiment, the etching rate of the lower dielectric sublayer is higher than that of the upper dielectric sublayer. To adjust the etching rates of the upper and lower dielectric sublayers, the same additive is used in different quantities to the upper and lower dielectric sublayers, which are made of the same main material. For example, titanium dioxide ($TiO_2$) is added in different quantities to the upper and lower dielectric sublayers of the dielectric layer, which are made of a main material such as silicon dioxide ($SiO_2$), or compounds which include silicon dioxide ($SiO_2$) or lead oxide (PbO). The etching rate of each of the upper and lower dielectric sublayers can thereby be adjusted. The combination of the upper and lower dielectric sublayers varies according to the kind and quantity of the etching solution. Further, the kind and quantity of the additive can vary according to the kinds of the etching solution so as to secure a suitable etching rate. The upper and lower dielectric sublayers should have the same permittivity to prevent the dielectric layer from cracking while being formed.

The dielectric layer is not limited to the foregoing bilayered structure, and may have a multi-layered structure such as a three or more layered structure.

FIGS. 3A through 3I show stages of a method of fabricating a flat panel display according to one embodiment of the invention. An electron emission device, for example, a field emission display (FED), includes an electron emission source formed as a CNT. First, a cathode layer 22', e.g., an ITO layer, is formed on a plate such as the glass plate 21' shown in FIG. 3A. Then, the ITO layer 22' is patterned (referring to FIG. 3B). A dielectric layer 23' is then formed on the patterned ITO layer 22' (referring to FIG. 3C). A gate layer 26' is formed on the dielectric layer 23' (referring to FIG. 3D) and the gate layer 26' is patterned to have an etching hole (referring to FIG. 3E). The dielectric layer 23' is then etched to form a negative hole 27' (referring to FIG. 3F). The remaining gate metal adjacent to the negative hole 27' is removed (referring to FIG. 3G), and the gate layer 26' is patterned and etched to form a gate (referring to FIG. 3H). A CNT paste is then injected, exposed, developed, annealed and activated to form a CNT emitter 30' (referring to FIG. 3I), thereby completing a lower plate. Thereafter, the lower plate is attached to an upper plate (not shown) in vacuum, thereby fabricating the FED.

A dielectric layer can alternatively be formed as double sublayers that differ from each other in etching rates according to a specific etching solution. As described above, the double sublayers have different quantities of an additive, that is, a lower dielectric sublayer could have an etching rate higher than that of an upper dielectric sublayer. Further, the thickness of the lower dielectric sublayer can be equal to or larger than that of the upper dielectric sublayer.

To form each dielectric layer, dielectric pastes different in etching rate from each other are applied by a well-known method such as sputtering, or screen printing, and are then dried and annealed.

Standard conditions for forming the dielectric layer, for example, applying conditions, applying quantities, drying temperature, drying time, drying atmosphere, annealing temperature, annealing time, and annealing atmosphere are known in the field of the present invention and will not be further elaborated in this disclosure.

In another embodiment of a method of forming the negative hole, the double dielectric layers that differ in their etching rates are etched with one etching solution. The etching solution may be determined based on of the kinds of dielectric material forming the dielectric layer, the kinds of the additives, the quantities of the additive, and the etching rates for the dielectric material. For example, a compound of water: fluoric acid:nitric acid having a weight percentage in the range of 10~40:1:1 can be employed as the etching solution. Alternatively, a small quantity of ingredients may be included in the combination in order to change the etching characteristics of the solution.

In an exemplary embodiment, the etching rate for completely etching the dielectric layer is 20 seconds or more to insure control of the etching process. For example, in the case where the dielectric layer has a thickness of 15 μm, the etching rate can be set to 0.75 μm/s. The etching process may be performed by a dipping or spraying method according to known processing conditions.

Two exemplary embodiments of a method according to the present invention are described in more detail below. However, the present invention is not limited to the following embodiments.

EXAMPLE 1

A dielectric paste is formed by adding weight percentage 50% of lead oxide (PbO) and weight percentage 4% of titanium dioxide to silicon dioxide ($SiO_2$), and the dielectric paste is used to form an upper dielectric sublayer. Further, using the same method, the weight percentage of the foregoing titanium oxide is changed from 4% to 2% in order to form the dielectric paste for a lower dielectric sublayer.

After patterning the ITO layer on a glass plate, the dielectric paste for the lower dielectric sublayer is applied to the ITO layer by a screen-printing method with an average thickness of 10 μm and then dried. The dielectric paste for the upper dielectric sublayer is then applied to the lower dielectric sublayer by a sputtering method with an average thickness of 5 μm and then dried. Thereafter, the upper and lower dielectric sublayers are annealed. Then, chromium (Cr) is sputtered on the annealed dielectric layer, thereby forming a gate layer. The gate layer is patterned to form an etching hole, and the plate is then dipped into the etching solution at room temperature for 25 seconds, wherein a compound of water: fluoric acid:nitric acid having a weight percentage of 20:1:1 is employed as the etching solution. As the gate layer is etched, the negative hole having a protruded portion is formed.

Figure 4A:
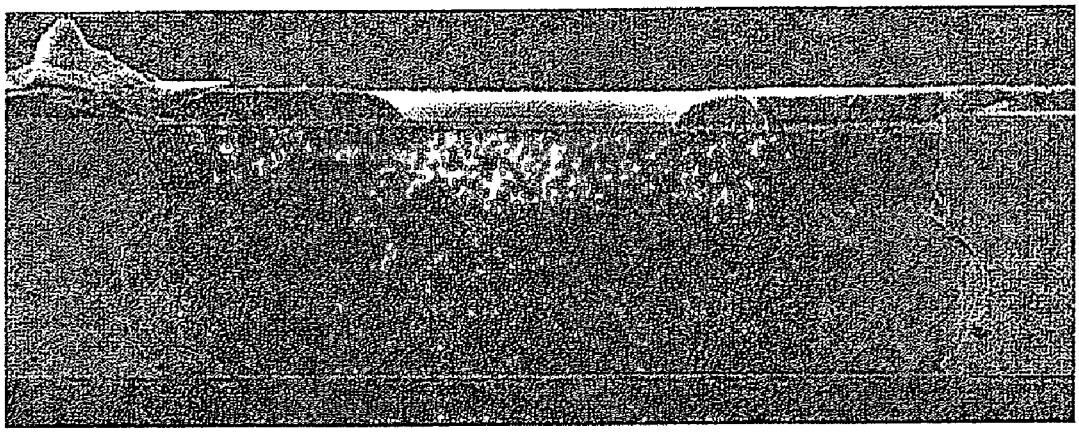
FIG. 4A is a scanning electron microscope (SEM) photograph showing the profile of a negative hole according to an embodiment of the present invention.

FIG. 4A is a SEM photograph showing a profile of the negative hole formed according to this exemplary method. As shown in FIG. 4A, the protruded portion is formed in a boundary between the upper dielectric sublayer and the lower dielectric sublayer along an inner wall of the negative hole.

After patterning the gate, CNT paste is applied thereon and dried. Then, the CNT paste is processed by rear exposure to form a CNT emitter within the negative hole, and the CNT emitter is activated, thereby completing a lower plate of the FED. Gate terminals and cathode terminals of one hundred twenty eight electron emission devices fabricated as described above are connected in parallel, and resistance between the gate and the cathode is measured. The measured resistance between the gate and the cathode, together with each permittivity of the upper and lower dielectric sublayers, is summarized in Table 1.

EXAMPLE 2

In this embodiment, a dielectric paste is formed by adding weight percentage 60% of lead oxide (PbO) to silicon dioxide ($SiO_2$), and is used to form a lower dielectric sublayer. The dielectric paste is then formed by adding weight percentage 50% of lead oxide (PbO) to silicon dioxide ($SiO_2$), and is used to form an upper dielectric sublayer. A compound of water: fluoric acid:nitric acid having a weight percentage of 10:1:1 is employed as the etching solution. The formation of the additional layers is completed as discussed in Example 1.

Resistance between the gate and the cathode is measured in the same method as the Example 1. The measured resistance between the gate and the cathode is summarized in Table 1.

Figure 4B:
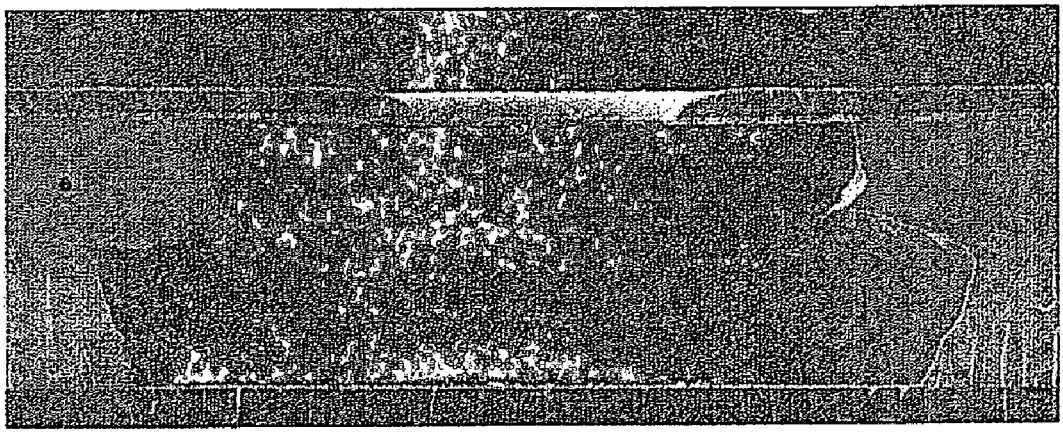
FIG. 4B is an SEM photograph showing the profile of a negative hole according to another embodiment of the present invention.

Referring to FIG. 4B, a protruded portion is formed in a boundary between the upper dielectric sublayer and the lower dielectric sublayer along an inner wall of a negative hole.

COMPARATIVE EXAMPLE

In this embodiment, a silicon dioxide ($SiO_2$) paste is used to form a single dielectric layer, and a compound of water: fluoric acid:nitric acid having a weight percentage of 40:1:1 is employed as the etching solution. The formation of the additional layers is completed as discussed in Example 1.

Figure 4C:
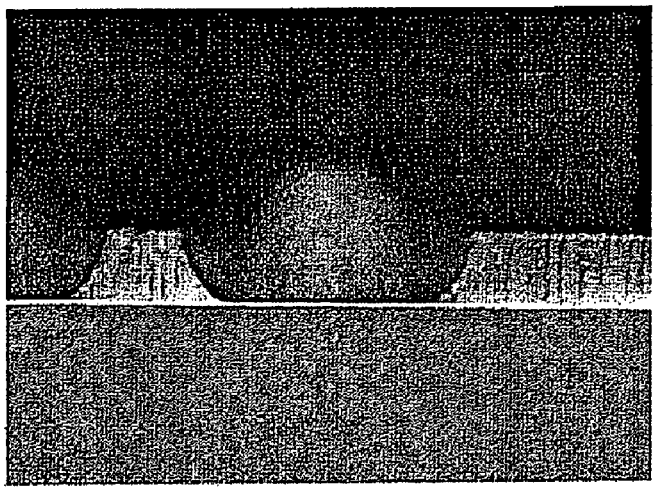
FIG. 4C is an SEM photograph showing a profile of a conventional negative hole.

FIG. 4C is a SEM photograph showing the profile of a negative hole formed according to a Comparative Example. A negative hole is formed by etching the single dielectric layer, having a straight vertical inner wall without a protruded portion.

Resistance between the gate and the cathode is measured in the same method as the Example 1. The measured resistance between the gate and the cathode, together with the permittivity of the upper and lower dielectric sublayers, is summarized in Table 1.

TABLE 1

| | Resistance | Remark |
|---|---|---|
| Example 1 | 420 MΩ | 12 times higher than Comparative Example |
| Example 2 | 470 MΩ | 13.4 times higher than Comparative Example |
| Comparative Example | 35 KΩ | |

In an electron emission display according to Examples 1 and 2, the negative hole is formed with a protruded portion in the boundary between the upper dielectric sublayer and the lower dielectric sublayer along the inner wall of the negative hole. The CNT remaining on the inner wall of the negative hole is effectively removed during the process of forming an emitter, including the process of annealing and activating the CNT emitter. The resistance between the cathode and the gate are secured as shown in the results of Table 1, thereby preventing an arc and signal distortion from being generated between the cathode and the gate.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims and their equivalents.

What is claimed is:

1. A dielectric layer comprising:

a lower dielectric sublayer;

an upper dielectric sublayer adjacent the lower dielectric sublayer and having substantially the same permittivity as the lower dielectric sublayer; and a negative hole in the dielectric layer, the negative hole having a protruded portion protruding from at least a boundary between the lower dielectric sublayer and the upper dielectric sublayer, the protruded portion forming a narrowest width of the negative hole.

2. The dielectric layer according to claim 1, wherein the lower dielectric sublayer has a higher etching rate than the upper dielectric sublayer.

3. The dielectric layer according to claim 2, wherein the upper dielectric sublayer comprises a first quantity of titanium dioxide ($TiO_2$), and the lower dielectric sublayer comprises a second quantity of titanium dioxide ($TiO_2$) which is different from the first quantity.

4. The dielectric layer according to claim 3, wherein the upper dielectric sublayer and lower dielectric sublayer further comprise a same main material.

5. The dielectric layer according to claim 4, wherein the same main material comprises a silicon oxide.

6. The dielectric layer according to claim 4, wherein the same main material comprises lead oxide.

7. The dielectric layer according to claim 1, wherein a peak of the protruded portion is positioned higher than a half thickness of the dielectric layer.

8. An electron emission device comprising:

a first electrode formed on a plate;

a dielectric layer formed on the first electrode and having a negative hole through which at least a portion of the first electrode is exposed, the dielectric layer comprising at least a lower dielectric sublayer adjacent the first electrode, and an upper dielectric sublayer adjacent the lower dielectric sublayer and having substantially the same permittivity as the lower dielectric sublayer;

an electron emission source on a region of the first electrode and having at least one portion exposed through the negative hole; and a second electrode on the dielectric layer, wherein the negative hole has an etched profile with a protruded portion protruding from at least a boundary between the lower dielectric sublayer and the upper dielectric sublayer, and wherein the protruded portion comprises a narrowest width of the negative hole.

9. The electron emission device according to claim 8, wherein the lower dielectric sublayer has a higher etching rate than the upper dielectric sublayer.

10. The electron emission device according to claim 9, wherein the lower dielectric sublayer comprises a first quantity of titanium dioxide and the upper dielectric sublayer comprises a second quantity of titanium dioxide which is different from the first quantity.

11. The electron emission device according to claim 8, wherein a peak of the protruded portion is positioned higher than half the thickness of the dielectric layer.

12. The electron emission device according to claim 11, wherein the first electrode comprises ITO, and the electron emission source comprises a CNT emitter.

* * * * *

UNITED STATES PATENT AND TRADEMARK OFFICE

CERTIFICATE OF CORRECTION

PATENT NO. : 7,567,027 B2
APPLICATION NO. : 11/097098
DATED : July 28, 2009
INVENTOR(S) : Sang Jin Lee It is certified that error appears in the above-identified patent and that said Letters Patent is hereby corrected as shown below:

On the Title Page

Abstract: line 4 Delete "lower"

Signed and Sealed this
Fifth Day of April, 2011

David J. Kappos

David J. Kappos
*Director of the United States Patent and Trademark Office*